US006684737B1

(12) United States Patent
Schulze-Beckinghausen et al.

(10) Patent No.: US 6,684,737 B1
(45) Date of Patent: Feb. 3, 2004

(54) POWER TONG

(75) Inventors: Joerg Eric Schulze-Beckinghausen, Garbsen (DE); Bernd-Georg Pietras, Wedemark (DE)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/890,314

(22) PCT Filed: Dec. 24, 1999

(86) PCT No.: PCT/GB99/04448

§ 371 (c)(1),
(2), (4) Date: Jan. 4, 2002

(87) PCT Pub. No.: WO00/45027

PCT Pub. Date: Aug. 3, 2000

(30) Foreign Application Priority Data

Jan. 28, 1999 (GB) ..... 9901777

(51) Int. Cl.[7] ..... B25B 13/50
(52) U.S. Cl. ..... 81/57.33; 81/57.16; 81/57.19
(58) Field of Search ..... 81/57.33, 57.15, 81/57.16, 57.19, 57.21, 57.34

(56) References Cited

U.S. PATENT DOCUMENTS

| | | | | |
|---|---|---|---|---|
| 1,386,908 | A | 8/1921 | Taylor | |
| 1,842,638 | A | 1/1932 | Wigle | |
| 2,214,194 | A | 9/1940 | Frankley | 251/84 |
| 2,214,429 | A | 9/1940 | Miller | 166/16 |
| 2,522,444 | A | 9/1950 | Grable | 166/16 |
| 2,610,690 | A | 9/1952 | Beatty | 166/16 |
| 2,950,639 | A | 8/1960 | Mason | 81/53 |
| 3,021,739 | A | 2/1962 | Grundmann | 81/53 |
| 3,041,901 | A | 7/1962 | Knights | 81/53 |
| 3,086,413 | A | 4/1963 | Mason | 81/53 |
| 3,122,811 | A | 3/1964 | Gilreath | 24/263 |
| 3,180,186 | A | 4/1965 | Catland | 81/57 |
| 3,220,245 | A | 11/1965 | Winkle | 73/46 |
| 3,302,496 | A | 2/1967 | Mitchell et al. | 81/53 |
| 3,349,455 | A | 10/1967 | Doherty | 24/263 |
| 3,443,291 | A | 5/1969 | Doherty | 24/263 |
| 3,475,038 | A | 10/1969 | Matherne | 285/27 |
| 3,518,903 | A | 7/1970 | Ham et al. | 81/57.16 |
| 3,559,739 | A | 2/1971 | Hutchison | 166/311 |
| 3,747,675 | A | 7/1973 | Brown | 166/237 |

(List continued on next page.)

FOREIGN PATENT DOCUMENTS

| | | | |
|---|---|---|---|
| DE | 2 128 362 | 1/1972 | E21B/19/00 |
| EP | 0 285 386 | 5/1988 | E21B/19/16 |
| EP | 0 311 455 | 12/1989 | E21B/19/16 |
| EP | 0 423 055 | 4/1991 | E21B/17/043 |
| EP | 0 525 247 | 3/1993 | E21B/3/02 |
| GB | 2 300 896 A | 11/1996 | F16K/3/08 |
| WO | WO 83/03443 | 10/1983 | E21B/19/16 |
| WO | 95/20471 | 8/1995 | B25B/17/00 |
| WO | WO 98/16716 | 4/1998 | E21B/21/00 |
| WO | WO 98/32948 | 7/1998 | E21B/19/16 |
| WO | WO 99/34089 | 7/1999 | E21B/19/16 |
| WO | WO 99/34090 | 7/1999 | E21B/21/00 |
| WO | WO 99/34091 | 7/1999 | E21B/21/00 |
| WO | WO 00/22278 | 4/2000 | E21B/19/16 |
| WO | WO 00/23686 | 4/2000 | E21B/19/16 |
| WO | WO 00/79092 | 12/2000 | E21B/21/08 |
| WO | WO 01/03889 A1 | 1/2001 | B25B/17/00 |
| WO | WO 01/66905 A3 | 9/2001 | E21B/19/16 |

*Primary Examiner*—Joseph J. Hail, III
*Assistant Examiner*—David B. Thomas
(74) *Attorney, Agent, or Firm*—Moser, Patterson & Sheridan, L.L.P.

(57) ABSTRACT

This invention relates to a rotary and a method for facilitating the connection of pipes, and more particularly, but not exclusively, to a rotary for a powered drill pipe tong for facilitating the connection of sections or strands of drill pipe to a string of drill pipe.

27 Claims, 2 Drawing Sheets

U.S. PATENT DOCUMENTS 3,838,613 A 10/1974 Wilms ..... 81/57.34
3,933,108 A 1/1976 Baugh ..... 114/0.5 D
3,941,348 A 3/1976 Mott ..... 251/58
3,986,564 A * 10/1976 Bender ..... 173/4
4,005,621 A 2/1977 Turner, Jr. et al. ..... 81/57.2
4,142,739 A 3/1979 Billingsley ..... 285/18
4,159,637 A 7/1979 Lamb et al. ..... 73/46
4,170,908 A * 10/1979 Peveto et al. ..... 81/57.11
4,221,269 A 9/1980 Hudson ..... 173/163
4,246,809 A 1/1981 Keast et al. ..... 81/57.16
4,257,442 A 3/1981 Claycomb ..... 137/238
4,262,693 A 4/1981 Giebeler ..... 137/494
4,291,762 A 9/1981 Gudgel ..... 166/85
4,295,527 A 10/1981 Russe ..... 166/135
4,315,553 A 2/1982 Stallings ..... 175/207
4,346,629 A * 8/1982 Kinzbach ..... 81/57.2
4,401,000 A 8/1983 Kinzbach ..... 81/57.2
RE31,699 E 10/1984 Eckel ..... 73/862.25
4,492,134 A 1/1985 Reinholdt et al. ..... 81/57.34
4,499,919 A 2/1985 Forester ..... 137/613
4,565,003 A 1/1986 McLeod ..... 29/281.1
4,573,359 A 3/1986 Carstensen ..... 73/761
4,593,773 A 6/1986 Skeie ..... 175/85
4,643,259 A 2/1987 Zeringue, Jr. ..... 166/77.5
4,709,766 A 12/1987 Boyadjieff ..... 175/52
4,715,625 A 12/1987 Shows, Jr. et al. ..... 285/145
4,773,218 A * 9/1988 Wakita et al. ..... 60/476
4,938,109 A 7/1990 Torres et al. ..... 81/467
4,979,356 A * 12/1990 Vatne ..... 81/57.16
5,022,472 A 6/1991 Bailey et al. ..... 175/195
5,044,232 A * 9/1991 Schulze-Beckinghausen ..... 81/57.18
5,150,642 A 9/1992 Moody et al. ..... 81/57.2
5,159,860 A * 11/1992 Pietras ..... 81/57.19
5,161,438 A 11/1992 Pietras ..... 81/57.16
5,167,173 A * 12/1992 Pietras ..... 81/57.15
5,209,302 A 5/1993 Robichaux et al. ..... 166/355
5,221,099 A 6/1993 Jansch ..... 279/151
5,259,275 A 11/1993 Schulze-Beckinghausen ..... 81/57.16
5,297,833 A 3/1994 Willis et al. ..... 294/102.2
5,390,568 A 2/1995 Pietras ..... 81/57.16
5,451,084 A 9/1995 Jansch ..... 294/1.1
5,520,072 A * 5/1996 Perry ..... 81/57.16
5,634,671 A 6/1997 Watkins ..... 285/18
5,706,893 A 1/1998 Morgan ..... 166/86.1
5,730,471 A 3/1998 Schulze-Beckinghausen et al. ..... 285/18
5,746,276 A 5/1998 Stuart ..... 173/1
5,787,982 A 8/1998 Bakke ..... 166/242.6
5,819,605 A 10/1998 Buck et al. ..... 81/57.33
5,839,330 A 11/1998 Stokka ..... 81/57.33
5,842,390 A 12/1998 Bouligny et al. ..... 81/57.34
5,845,549 A 12/1998 Bouligny ..... 81/57.33
5,890,549 A 4/1999 Sprehe ..... 175/71
5,992,801 A 11/1999 Torres ..... 248/49
6,065,372 A 5/2000 Rauch ..... 81/57.15
6,082,224 A * 7/2000 McDaniels et al. ..... 81/57.15
6,119,772 A 9/2000 Pruet ..... 166/81.1
6,138,529 A 10/2000 Pietras ..... 81/57.33
6,161,617 A 12/2000 Gjedebo ..... 166/77.52
6,206,096 B1 3/2001 Belik ..... 166/77.51
6,305,720 B1 10/2001 Spiering et al. ..... 285/18
6,327,938 B1 * 12/2001 Pietras ..... 81/57.33
6,330,911 B1 12/2001 Allen et al. ..... 166/77.51
6,360,633 B2 3/2002 Pietras ..... 81/57.34
6,412,554 B1 7/2002 Allen et al. ..... 166/80.1
6,480,811 B2 11/2002 Denny et al. ..... 702/188

* cited by examiner

POWER TONG

BACKGROUND OF THE INVENTION

This invention relates to a rotary and a method for facilitating the connection of pipes, and more particularly, but not exclusively, to a rotary for a powered drill pipe tong for facilitating the connection of sections or stands of drill pipe to a string of drill pipe.

Drill pipe tongs are commonly used for facilitating the connection of sections or stands of drill pipe to a pipe string. Typically, the pipe string hangs in a wellbore from a spider in a floor of an oil or gas rig.

A section or stand of drill pipe to be connected to the pipe string is swung in from a drill pipe rack to the well centre above the pipe string. A pipe handling arm may be used to guide the drill pipe to a position above the pipe string. A stabbing guide may then be used to align a threaded pin of the drill pipe with a threaded box of the pipe string. A drill pipe tong is then used to tighten the connection to a torque of typically 68,000 Nm (50,000 lb.ft)

The drill pipe tong is also used for disconnecting drill pipe. This operation involves breaking the connection which requires a torque typically greater than the tightening torque which may typically be in the order of 110,000 Nm (80,000 lb.ft).

A drill pipe tong generally comprises jaws mounted in a rotary which is rotatably arranged in a housing. The jaws are moveable relative to the rotary in a generally radial direction towards and away from an upset part of the pipe to be gripped. The upset parts of the pipe are generally located above the pin and below the box of the pipe and have an enlarged outer diameter and/or a reduced inner diameter.

In use, the rotary is rotated forcing the jaws along cam surfaces towards the upset part of the section of pipe. Once the jaws fully engage the upset part, the rotary carries on rotating applying torque to the threads and hence tightens the connection between the section of pipe and the pipe string.

Several problems have been observed with such prior art drill pipe tongs.

In particular, such drill pipe tongs can badly scar the upset part of the pipe, particularly if the jaws start rotating relative to the drill pipe.

Once scarred, the pipe is then lowered into the wellbore. Friction between the wellbore (or casing lining the wellbore) and the scarred upset grinds the upset, reducing the diameter.

Scarring of the upset may also be caused by having to reapply the jaws. This is especially common when connecting pipe with "wedge threads" which requires approximately 80° of turn in order to toque the connection. Many prior art wrenching tongs need to be reapplied to the pipe every 25°.

A reduction in diameter of the upset requires the use of a new drill pipe tong or for the old drill pipe tong to be modified therefor.

An attempt at solving this problem is disclosed in PCT Publication Number WO 92/18744, which discloses a rotary comprising hydraulically operated active jaws and stationary passive jaws. The hydraulically activated jaws are engaged fully with the pipe prior to rotation of the rotary, thereby substantially reducing scarring. A hydraulic circuit is provided on the rotary for actuating the jaws. A plunger is used to activate the hydraulic system by depressing a hydraulic piston of the hydraulic circuit repeatedly. This operation takes time. If several seconds can be saved per connection, the overall cost of the construction of an oil or gas well can be drastically reduced, as long as reliability is not sacrificed.

Another problem associated with the rotary disclosed in PCT Publication Number WO 92/18744 is that repeated depressing of the plunger for engaging the jaws fully with the pipe may itself cause some scaring.

SUMMARY OF THE PRESENT INVENTION

According to a first aspect of the invention, there is provided a rotary comprising at least one jaw and means for displacing said at least one jaw, characterised in that said means is actuable by or connectable to pneumatic fluid.

Preferably, said pneumatic fluid is supplied from a supply external to said rotary.

Advantageously, said supply is connectable to said rotor by a coupling.

Preferably, said at least one jaw is displaceable on a piston.

Advantageously, said means for displacing said at least one jaw comprises a hydraulic circuit.

Preferably, said hydraulic circuit comprises a hydraulic pump driven by said pneumatic fluid.

Advantageously, said hydraulic circuit comprises a bellows which, in use may be used to pressurise said hydraulic circuit.

Preferably, said hydraulic circuit comprises an accumulator, which in use, is used to displace said at least one jaw.

Advantageously, said rotary comprises three jaws, all of which are displaceable by said means.

There is also provided a method for facilitating the connection of pipes using the rotary of the first aspect of the invention, the method comprising the step of applying pneumatic fluid to said means to displace said at least one jaw.

According to a second aspect of the invention, there is provided a rotary comprising at least one jaw and hydraulic fluid in a hydraulic circuit for displacing said at least one jaw, characterised in that said rotary comprises a pump for pumping said hydraulic fluid through said hydraulic circuit.

Preferably, said at least one jaw is displaceable on a piston.

Advantageously, said pump is drivable by a pneumatic fluid.

Preferably, said rotary further comprises an accumulator, which in use is charged by said hydraulic pump for displacing said at least one jaw. The accumulator may be used for disengaging the at least one jaw from a pipe and/or for engaging the at least one jaw with a pipe.

There is also provided a method for facilitating the connection of pipes using the rotary of the second aspect of the invention, the method comprising the step of pumping hydraulic fluid through said hydraulic circuit to displace said at least one jaw.

The rotary disclosed in PCT Publication Number WO 92/18744 comprises an accumulator for maintaining full engagement of said jaws with a pipe in case of any leaks or movement of the jaws. A similar device is used in the specific embodiment of the present invention, but is referred to as a bellows.

According to a third aspect of the invention, there is provided a rotary comprising at least one jaw and means for displacing said jaw characterised in that said rotary comprises an accumulator for storing a charge for displacing said jaw. The accumulator may be used to displace said at least one jaw for disengaging a pipe or engaging a pipe. The accumulator may comprise a hydraulic accumulator or any other form of energy storage device, for example a spring or an electrical accumulator (not recommended).

Preferably, said at least one jaw is displaceable on a piston.

Advantageously, said means for displacing said jaws comprises a hydraulic circuit.

Preferably, said hydraulic circuit comprises a pump for charging said accumulator.

Advantageously, said pump is drivable by said pneumatic fluid.

Preferably, said accumulator is provided with a check valve arranged in series, such that said accumulator may be charged therethrough inhibiting said is accumulator discharging.

Advantageously, said accumulator is provided with a release valve arranged in series therewith, such that upon actuation of said release valve said charge discharges from said accumulator to displace said at least one jaw.

Preferably, said release valve is provided with at least a second release valve arranged in parallel therewith.

There is also provided a method for facilitating the connection of pipes using the rotary of the third aspect of the invention, the method comprising the step of charging said accumulator and using said charge to displace said at least one jaw.

Another problem associated with the rotary disclosed in PCT Publication Number WO 92/18744 is that disengagement of the jaws is carried out by relieving the pressure of the hydraulic fluid in the hydraulic circuit and moving the jaws from engagement with a pipe manually.

According to a forth aspect of the invention there is provided a rotary comprising at least one jaw and means for moving said jaw into engagement with a pipe, characterised in that there is also provided power operable retracting means for retracting said at least one jaw.

Preferably, said at least one jaw is displaceable on a piston.

Advantageously, said retracting means comprises an accumulator.

Preferably, said means for displacing said at least one jaw comprises a hydraulic circuit.

Advantageously, said hydraulic circuit comprises a pump for charging said accumulator.

Preferably, the accumulator is located in said rotary.

There is also provided a method for facilitating the connection of pipes using the rotary of the forth aspect of the invention, the method comprising the step of operating said disengagement means for disengaging said at least one jaw from a pipe.

Another problem associated with the rotary disclosed in PCT Publication Number WO 92/18744 is that the hydraulic circuit arranged on the rotary comprises a reservoir which is open to the ambient air and may allow hydraulic fluid to leak therefrom.

According to a fifth aspect of the invention there is provided a rotary comprising at least one jaw and hydraulic fluid in a hydraulic circuit for displacing said jaw characterised in that said hydraulic circuit is sealed. No hydraulic fluid is open to air.

Preferably, said hydraulic circuit comprises a bellows for containing hydraulic fluid.

BRIEF DESCRIPTION OF THE DRAWINGS

For a better understanding of the invention, reference will now be made, by way of example, to the accompanying drawings, in which.

DETAILED DESCRIPTION

Figure 1:
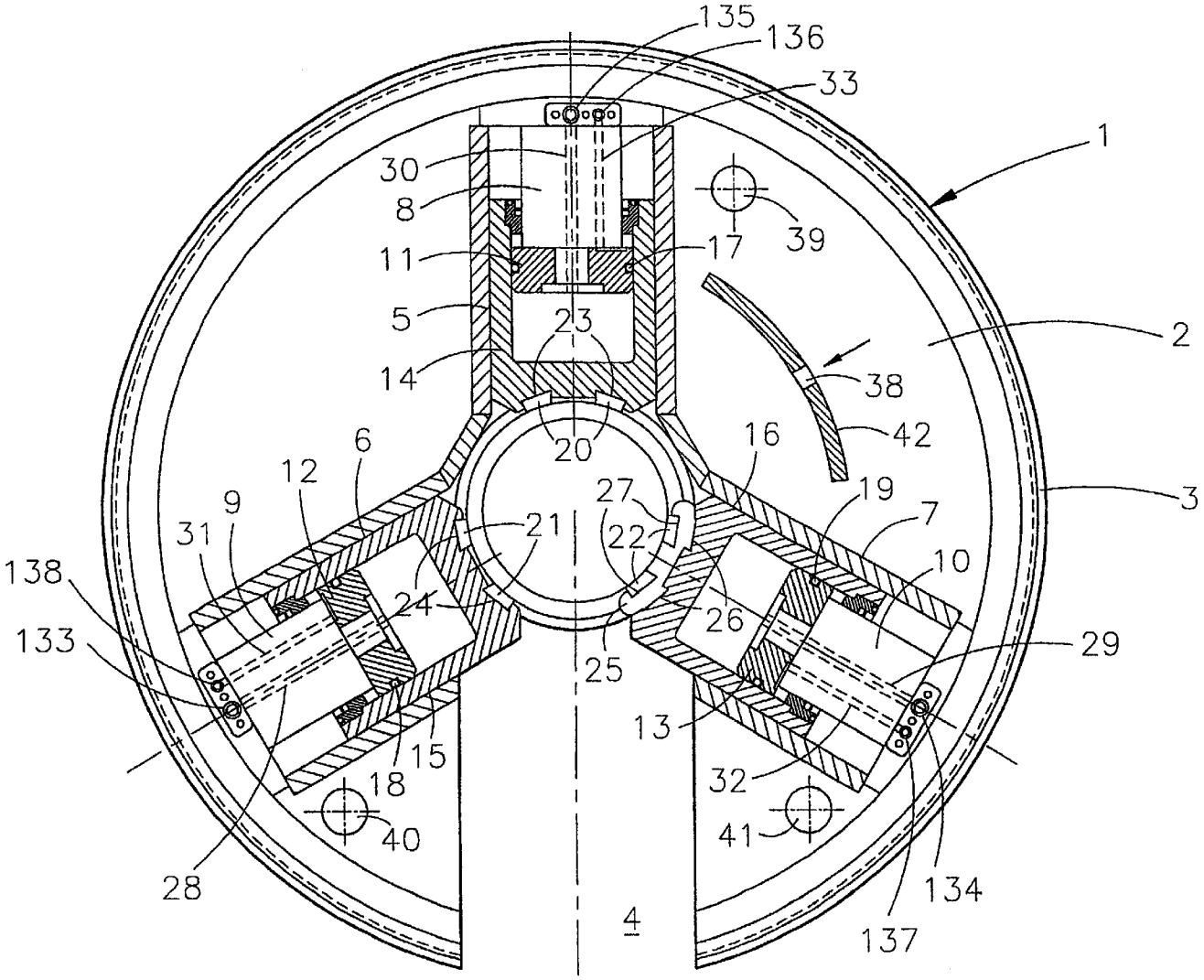
FIG. 1 is a top plan view of a rotary of a drill pipe tong in accordance with the invention with parts shown in cross-section.

Referring to FIG. 1 there is shown a rotary which is generally identified by reference numeral 1.

The rotary 1 comprises a rigid housing 2 which is provided with a toothed perimeter 3 for engagement with toothed drive wheels in a stator of the drill pipe tong (not shown). The housing 2 is also provided with an opening 4 for receiving a drill pipe.

Three piston and cylinders 5, 6 and 7 are arranged about the rotary 1 spaced at 120° to each other and are directed to the centre of the rotary 1. The piston and cylinders 5, 6 and 7 comprise pistons 8, 9 and 10 each provided with a piston head 11, 12 and 13. Cylinders 14, 15 and 16 are slidable along said piston heads 11, 12 and 13 towards and away from the centre of the rotary 1. Sealing rings 17, 18 and 19 are provided in the piston heads 11, 12 and 13 between the piston heads 11,12 and 13 and the cylinders 14, 15 and 16.

Cylinders 14, 15 and 16 are provided with jaws 20, 21 and 22 for engaging with the upset of a drill pipe. The jaws 20 and 21 are located in corresponding dovetail slots 23 and 24. The cylinder 16 is shown provided with an extension member 25 between the cylinder 16 and the jaws 22. The extension member 25 is located in dovetail slots 26 and the gripping elements 22 are located in corresponding dovetail slots 27 in the extension member 25. In use, either all of the cylinders 14, 15 and 16 are provided with extension members 25 or none of the cylinders 14, 15 and 16 are provided with extension members 25.

Hydraulic lines 28, 29 and 30 and hydraulic lines 31, 32 and 33 are arranged in each piston 8, 9 and 10 for the provision of hydraulic fluid in front of and behind the piston heads 11, 12 and 13.

A quick release pneumatic fluid supply connection 38, an accumulator switch 39 and two release switches 40 and 41 are arranged on the housing 2.

The quick release pneumatic fluid supply connection 38 is slidably arranged in a slot 42 in the housing 2. The slot 42 is shaped to be concentric with the perimeter of the rotary 1. This allows the rotary 1 to rotate a few degrees with a pneumatic fluid supply line attached.

The release switches 40 and 41 are arranged on opposite sides of the rotary so that, when release of the gripping elements 20, 21 and 22 from the drill pipe is required, at least one will be within easy reach of an operator. In particular, in use, part of the stator of the drill pipe tong (not shown) may obscure use of one of the release switches.

Figure 2:
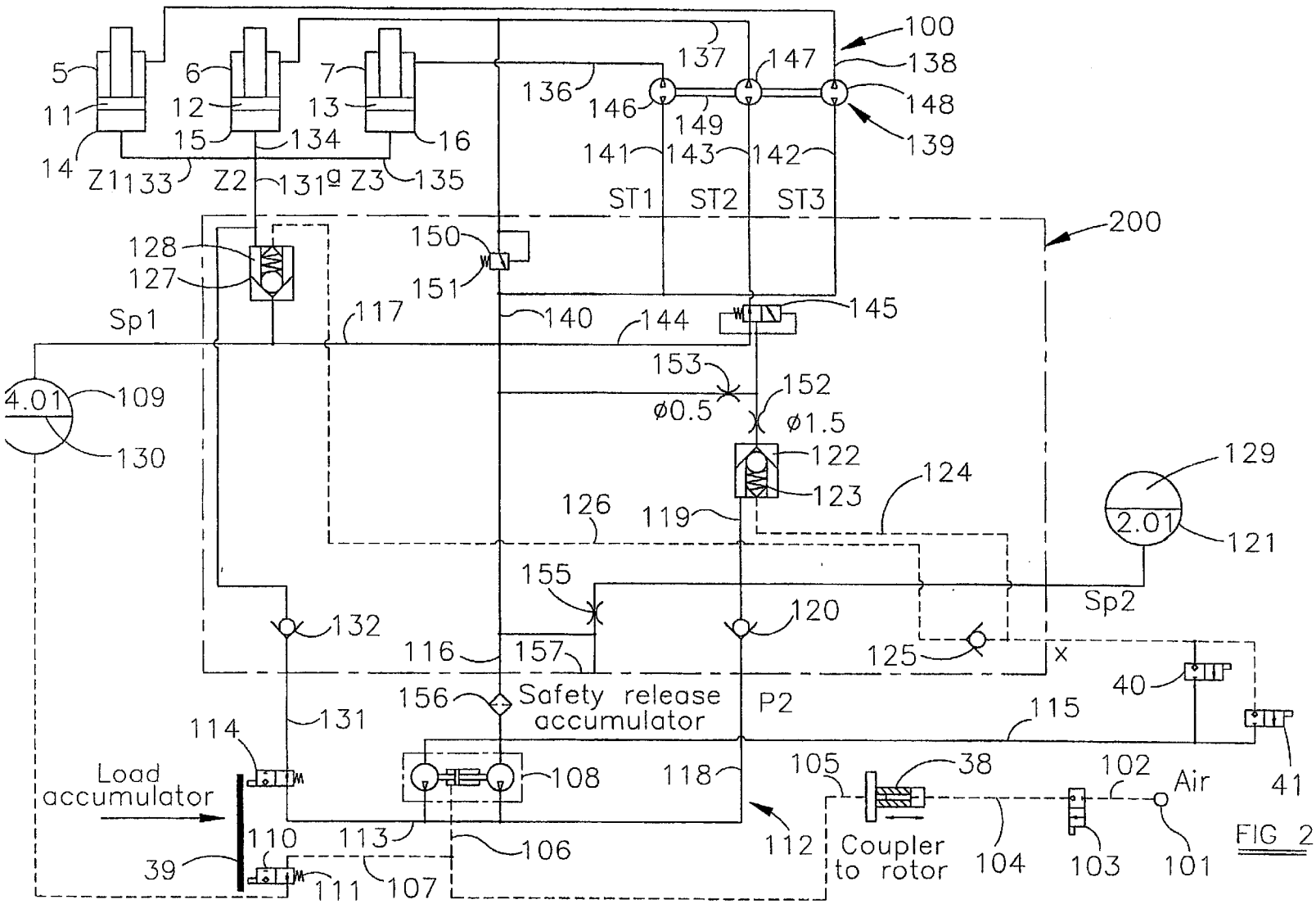
FIG. 2 is a schematic of a part hydraulic, part pneumatic circuit used in the rotary of FIG. 1.

Referring now to FIG. 2 there is shown a circuit which is generally identified by reference numeral 100 arranged in and on the housing 2 of the rotary 1.

The circuit 100 is provided with a quick release pneumatic fluid connection 38 slidably arranged in slot 42 of the housing 2 of the rotary 1. The pneumatic fluid is supplied from a source 101 via hose 102, through a valve 103 and through hose 104 to the connection 38. The source supplies pneumatic fluid at approximately 10 bar. A pneumatic line 105 in the housing 2 divides into two branch lines 106 and 107 supplying a pneumatic pump 108 and a bellows 109 respectively. Pneumatic line 107 comprises an valve 110 which is biased by spring 111 to an open position to allow pneumatic fluid to flow to bellows 109.

The circuit 100 is charged while the drill pipe tong is situated away from the drill pipe. This step is carried out by moving the valve 103 to an open position to allow pneumatic fluid to flow from source 101 through pneumatic line 105 and by depressing accumulator switch 39. With the accumulator switch 39 depressed, branch line 107 is blocked. Pneumatic fluid actuates pneumatic pump 108, which pumps hydraulic fluid around a sealed circuit 112.

Hydraulic fluid drawn through line 116 and 117 from the bellows 109 is pumped through line 118, through a check valve 120 into an accumulator 121. A line 119 leads from the rear of check valve 120 to a rear side of spring loaded check valve 122. The spring loaded check valve 122 is biased towards a closed position by a spring 123. A control line 124 leads from a rear side of the spring loaded check valve 122, in parallel with spring 123.

Since accumulator switch 39 is depressed hydraulic fluid is prevented from being pumped through line 113 by the valve 114 being in a closed position.

Hydraulic fluid is prevented from being pumped through a control line 124 by release valves 40, 41 which are closed and by a check valve 125. Hydraulic fluid is also prevented from being pumped through control line 126 by the check valve 125.

The check valves 120 and 125 inhibit high pressure hydraulic fluid escaping from the accumulator 121.

Control line 126 leads from a front side of the check valve 125 to the rear side of a spring loaded check valve 127 in parallel with a spring 128 which bias the spring loaded check valve 127 to a closed position.

Pneumatic fluid 129 in the accumulator 121 is compressed by the pneumatic pump 108 to approximately 280 bar. The pump 108 is prevented from overloading the accumulator by being designed to stall at 280 bar or by use of a pressure relief valve (not shown). The supply of pneumatic fluid is stopped by closing the valve 103The accumulator switch 39 is now released.

The drill pipe tong can now be offered up to the drill pipe (not shown). The drill pipe is located between the jaws 20, 21 and 22 of the rotary 1 through the opening 4.

The jaws 20, 21 and 22 are activated to engage the upset of the drill pipe by opening the valve 103. Pneumatic fluid flows through the valve 103, through line 105 into line 106 and drives the pump 108 and also through line 107 to one side of a membrane 130 in bellows 109, squeezing hydraulic fluid to the cylinders 14, 15 and 16 at a high flow rate. Hydraulic fluid pressure acting against spring 128 of the spring loaded check valve 127 opens the spring loaded check valve 127. A small amount of hydraulic fluid is allowed to seep from line 126 past the ball of the spring loaded check valve 122 as it opens.

The pump 108 pumps hydraulic fluid into line 113 through valve 114 into line 131, through a check valve 132 and into the cylinders 14, 15 and 16 via branch lines 133, 134 and 135. The pump 108 draws hydraulic fluid from the bellows 109 and from behind the piston heads 11, 12 and 13 through lines 136, 137 and 138, through device 139, through lines 141, 142 into line 140 and through line 143 into line 144 via a flow diverter 145, into line 116 into pump 108. The jaws 20, 21 and 22 engage the pipe. The pump 108 will stall or is stopped by removing the pneumatic fluid once the desired engaging force has been reached. This is typically when the pressure in the circuit 100 has built up to 280 bar.

It should be noted that, during this procedure, the accumulator 121 is simultaneously brought up to the same pressure as the engaging pressure if it does not already retain a pressure equal to or higher than the engaging pressure.

The flow diverter 145 is biased to allow fluid communication between lines 143 and 144. The device 140 comprises three rotors 146, 147 and 148 arranged on a common shaft 149. When hydraulic fluid flows through the rotors 146, 147 and 148, the rotors allow equal volumes of fluid to pass, thereby ensuring even movement of the jaws 20, 21 and 22 arranged on the cylinders 14, 15 and 16.

The hose 104 may now be disconnected from the connection 38.

The rotary 1 may now be rotated to rotate the drill pipe to connect drill pipe.

Once rotation has ceased, the jaws 20, 21 and 22 are disengaged and retracted from the drill pipe. This is carried out by pressing one or both of the release valves 40, 41. This allows hydraulic fluid to flow from the accumulator 121 through control line 124, through spring loaded check valve 122 and through release valves 40 and/or 41 into line 115, line 116 and line 117 to bellows 109. A small amount of hydraulic fluid is allowed to seep past the ball of the spring loaded check valve 122. Hydraulic fluid under pressure also flows from control line 126, allowing pressurised hydraulic fluid to flow from infront of the piston heads 11, 12 and 13 to bellows 109. High pressure hydraulic fluid shifts the flow diverter 145, allowing high pressure hydraulic fluid to flow into line 143. The flow through line 143 rotates the rotor 147, which rotatably drives rotors 146 and 148 via shaft 149 and sucks hydraulic fluid out of bellows 109 into the cylinders behind the piston heads 11, 12 and 13 and retracts the jaws 20, 21 and 22 in unison. A valve 150 is arranged in parallel with line 143 and bypasses the device 139. The valve 150 is biased by a spring 151 to a closed position, however upon the pressure increasing on the rear side of the piston head 12, the valve 150 opens equalling the flow rate between the driving rotor 147 and the driven rotors 146 and 148.

The hydraulic fluid in front of the piston heads 11, 12 and 13 is expelled through branch lines 133, 134 and 135 into line 131*a* and passes through spring loaded check valve 128 into line 117 and into bellows 109. The residual hydraulic fluid due to the difference in volumes of the cylinders 14, 15 and 16 when engaged and retracted, flows is stored in the bellows 109.

Restrictors 152 and 153 inhibit sudden changes in pressure upon depression of the release valve 40, 41 and the opening of spring loaded check valve 122. A safety release valve 155 is provided such that if pressure in the accumulator 121 needs to be released the safety valve can be operated to vent the hydraulic fluid to atmosphere or into a safety release accumulator 156. The safety release valve may be operated by a control or be a removable cap 157 in a block 200.

The valves 120, 122, 125, 127, 132, 145, 155 and the respective lines and control lines are arranged in a single block 200. The block 200 may be any suitable material such as aluminium, aluminium alloys or steel. It should be noted that the entire circuit 100 is arranged in or/and an the rotary 1. The pneumatic fluid source 101 is of the type provided on most drilling rigs and is typically at a pressure of 10 bar.

Various modifications are envisaged to the above apparatus. In particular, it is envisaged that a further accumulator could be provided for providing a charge for moving the jaws into engagement with a pipe. This has the advantage that the pneumatic fluid line may be removed from the drill pipe tong before the drill pipe tong is moved about the pipe thus saving vital seconds disconnecting the hose from the rotary.

It is also envisaged that the apparatus could be used with thin walled pipe, as it is relatively simple to alter the force applied to the pipe by the jaws.

It is also envisaged that the accumulator could take the form of a spring or a battery.

What is claimed is:

1. Amended) A rotary comprising at least one jaw and a hydraulic circuit for displacing said at least one jaw, characterized in that the hydraulic circuit is acted upon by a pneumatic fluid.

2. A rotary as claimed in claim 1 and comprising a lateral opening for receiving a drill pipe to be rotated, wherein said pneumatic fluid is supplied from a supply external to said rotary.

3. A rotary as claimed in claim 2, wherein said supply is connectable to said rotary by a coupling.

4. A rotary as claimed in claim 1, wherein said at least one jaw is displaceable on a piston.

5. A rotary as claimed in claim 1, wherein said hydraulic circuit comprises a hydraulic pump driven by said pneumatic fluid.

6. A rotary as claimed in claim 5, wherein said hydraulic circuit comprises a bellows which, in use maintains pressure in said hydraulic circuit.

7. A rotary as claimed in claim 1, wherein said hydraulic circuit comprises an accumulator, which in use, is used to displace said at least one jaw.

8. A rotary as claimed in claim 1, wherein said rotary comprises three jaws, all of which are displaceable by said means.

9. A method for facilitating the connection of pipes using the rotary as claimed in claim 1, wherein the method comprises the step of applying pneumatic fluid to said means to displace said at least one jaw.

10. A rotary comprising at least one jaw and means for said at least one jaw, characterized in that said rotary comprises an accumulator for storing a charge for displacing said jaw and a bellows for storing hydraulic fluid.

11. A rotary as claimed in claim 10, wherein said at least one jaw is displaceable on a piston.

12. A rotary as claimed in claim 10, wherein said means for displacing said at least one jaw comprises a hydraulic circuit.

13. A rotary as claimed in claim 10, wherein said hydraulic circuit comprises a pump for charging said accumulator.

14. A rotary as claimed in claim 13, wherein said pump is drivable by said pneumatic fluid.

15. A rotary as claimed in claim 10, wherein said accumulator is provided with a check valve arranged in series, such that said accumulator may be charged therethrough inhibiting said accumulator discharging.

16. A rotary as claimed in claim 10, wherein said accumulator is provided with a release valve arranged in series therewith, such that upon actuation of said release valve said charge discharges from said accumulator to displace said at least one jaw.

17. A rotary as claimed in claim 16, wherein said release valve is provided with at least a second release valve arranged in parallel therewith.

18. A method for facilitating the connection of pipes using the rotary as claimed in claim 10, the method comprising the step of charging said accumulator and using said charge to displace said at least one jaw.

19. A tong for rotating a tubular, comprising:

a plurality of jaws for engaging the tubular;

a hydraulic circuit for displacing at least one of the plurality of jaws; and a pump for pumping hydraulic fluid through the hydraulic circuit, wherein the pump is acted upon by a pneumatic fluid.

20. The tong of claim 19, wherein at least one of the plurality of jaws is displaceable on a piston.

21. The tong of claim 19, further comprising an accumulator charged by the pump for displacing at least one of the plurality of jaws.

22. The A tong of claim 19, wherein more than one of the plurality of jaws is displaced.

23. The tong of claim 22, further comprising a device for supplying hydraulic fluid to the displaced plurality of jaws such that they move in unison.

24. A method of facilitating the connection of tubulars, comprising:

providing a tong having a plurality of jaws;

pressurizing an accumulator in the tong to a predetermined pressure;

supplying pneumatic fluid to activate a pump;

activating the pump to circulate an operating fluid to actuate the plurality of jaw;

rotating at least one of the tubulars; and releasing the plurality of jaws.

25. The method of claim 24, further comprising providing a piston and cylinder assembly to displace the plurality of jaws.

26. The method of claim 25, wherein the fluid is circulated from behind the piston to the front of the piston to displace the plurality of jaws into engagement with the tubular.

27. A rotary, comprising:

at least one jaw;

a hydraulic circuit for displacing the at least one jaw, wherein the hydraulic circuit is sealed; and a bellows for containing hydraulic fluid flowing in the hydraulic circuit.

hydraulic fluid in a hydraulic circuit for displacing said jaw, characterized in that said hydraulic circuit is sealed.

* * * * *

UNITED STATES PATENT AND TRADEMARK OFFICE

CERTIFICATE OF CORRECTION

PATENT NO. : 6,684,737 B1 
DATED : February 3, 2004
INVENTOR(S) : Schulze-Beckinghausen et al.

It is certified that error appears in the above-identified patent and that said Letters Patent is hereby corrected as shown below:

Column 7,
Line 15, please delete “Amended)”

Column 8,
Line 26, please change “The A tong” to -- The tong --.

Signed and Sealed this

Seventeenth Day of August, 2004

JON W. DUDAS
*Acting Director of the United States Patent and Trademark Office*